United States Patent [19]

Forgione

[11] Patent Number: 4,575,715

[45] Date of Patent: Mar. 11, 1986

[54] HIGH TEMPERATURE ALARM SYSTEM WITH FUSIBLE LINK

[76] Inventor: Joseph Forgione, 6094 Millington, Millington, Tenn. 38053

[21] Appl. No.: 618,912

[22] Filed: Jun. 8, 1984

[51] Int. Cl.[4] ..... G08B 17/02

[52] U.S. Cl. ..... 340/590; 200/61.08; 337/407; 340/691

[58] Field of Search ..... 340/590, 691; 337/407, 337/406, 405, 401; 200/61.08

[56] References Cited

U.S. PATENT DOCUMENTS

| | | | |
|---|---|---|---|
| 598,508 | 2/1898 | Guthrie | 340/590 |
| 634,491 | 2/1900 | Froment | 340/590 |
| 662,032 | 11/1900 | Sitts | 340/590 |
| 910,118 | 1/1909 | Crutchfield | 340/590 |
| 2,552,331 | 5/1951 | Lamb | 340/590 |
| 2,710,393 | 6/1955 | Goldberg | 340/590 |
| 2,740,107 | 3/1956 | Sutton | 340/590 |
| 3,324,464 | 6/1967 | Edwards et al. | 340/590 |
| 4,264,892 | 4/1981 | Zonn | 340/546 |

*Primary Examiner*—Glen R. Swann, III

*Attorney, Agent, or Firm*—Walker & McKenzie

[57] ABSTRACT

First and second head portions are movably urged toward a closed position, a fusible link holding the head portions in an open position. Electrical contacts are mounted on the head portions for making electrical contact when the head portions are in the closed position to energize an electric circuit for producing an alarm signal (e.g., turning on the lights in the room and ringing the doorbell of the building) when the head portions are in the closed position.

4 Claims, 6 Drawing Figures

HIGH TEMPERATURE ALARM SYSTEM WITH FUSIBLE LINK

BACKGROUND OF THE INVENTION

1. Field of the Invention

The present invention relates, in general, to fire alarms or the like for producing an alarm signal when the temperature within a house or the like rises past a certain degree.

2. Description of the Prior Art

Heretofore, various fire alarms and the like have been developed. See, for example, Guthrie, U.S. Pat. No. 598,508; De Froment, U.S. Pat. No. 643,491; Sitts, U.S. Pat. No. 662,032; Crutchfield, U.S. Pat. No. 910,118; and Edwards, U.S. Pat. No. 3,324,464. None of the above patents disclose or suggest the present invention.

SUMMARY OF THE INVENTION

The present invention is directed toward improving upon prior alarm means and the like. The concept of the present invention is to provide an alarm means in which a fusible link is utilized to cause an alarm signal to be produced when the ambient temperature at the fusible link rises above a certain degree.

The alarm means of the present invention comprises, in general, a body means including a first head portion, a second head portion, the first and second head portions being movable between open and closed positions and being electrically insulated relative to one another when in the open position, and urging means for normally urging the first and second head portions to a closed position; first electrical contact means for being positioned on the first head portion of the body means; second electrical contact means for being positioned on the second head portion of the body means and for electrically contacting the first electrical contact means when the first and second head portions are urged to the closed position; fusible means for being attached relative to the first and second head portions and for normally holding the first and second head portions in the open position to normally hold the first and second electrical contact means out of electrical contact with one another, the fusible means being rendered ineffective at a certain temperature to then allow first and second electrical contact means to electrically contact one another; and circuit means for being electrically coupled to the first and second electrical contact means and for producing an alarm signal if the first and second electrical contact means make electrical contact with one another.

DESCRIPTION OF THE PREFERRED EMBODIMENT

The alarm means 11 of the present invention is adapted to produce an alarm signal when the temperature at a certain location rises to or above a certain degree. Thus, a preferred use of the alarm means 11 is to provide automatic fire protection to the occupants of a house, building or the like.

Figure 1:
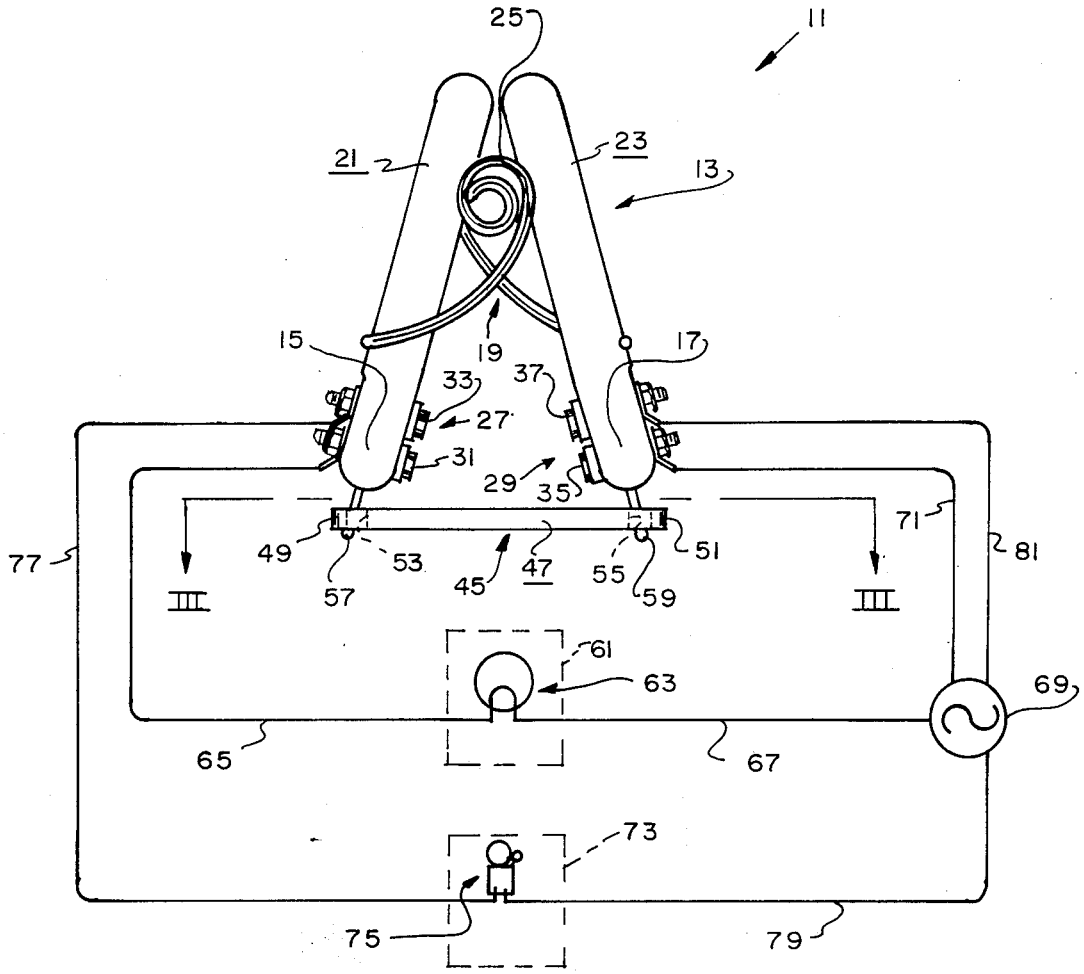
FIG. 1 is a somewhat diagrammatic view of the alarm means of the present invention showing the head portions of the body means in the open position.
Figure 4:
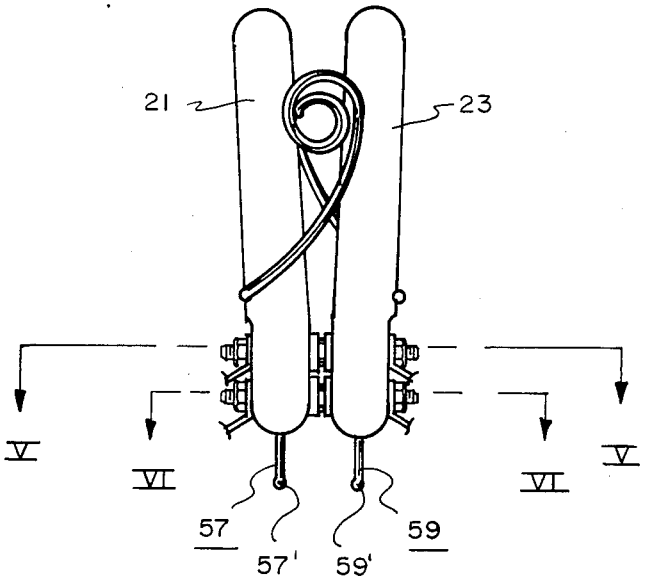
FIG. 4 is a front view of the body means of the alarm means of the present invention showing the head portions in the closed position.

The alarm means 11 includes a body means 13. The body means 13 includes a first head portion 15 and a second head portion 17. The first and second head portions 15, 17 are movable between an open position as shown in FIG. 1 and a closed position as shown in FIG. 4, and are electrically insulated relative to one another when in the open position. The body means 13 additionally includes urging means 19 for normally urging the first and second head portions 15, 17 to the closed position. The body means 13 preferably includes a first body member 21 and a second body member 23. Each body member 21, 23 has a first end and a second end with the first end of the first body member 21 defining the first head portion 15 and with the first end of the second body member 23 defining the second head portion 17. The urging means 19 preferably includes a spring member 25 for pivotally joining the first and second body members 21, 23 to one another in such a manner that the first ends thereof are movable between open and closed positions and normally urged to the closed position. The first and second body members 21, 23 are preferably constructed of an electrically nonconductive material, such as wood, plastic or the like. Thus, the body means 13 may consist basically of a typical clothes pin or the like of a construction well-known to those skilled in the art.

Figure 5:
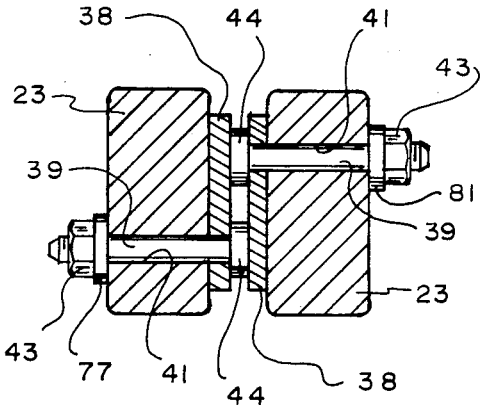
FIG. 5 is an enlarged sectional view substantially as taken on line V—V of FIG. 4.
Figure 6:
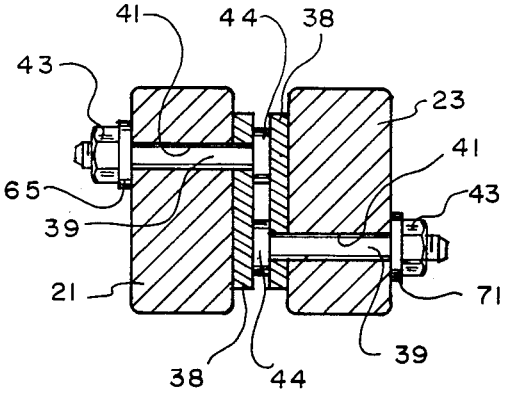
FIG. 6 is an enlarged sectional view substantially as taken on line VI—VI of FIG. 4.

The alarm means 13 includes a first electrical contact means 27 for being positioned on the first head portion 15 of the body means, and includes a second electrical contact means 29 for being positioned on the second head portion 17 (see FIG. 1) and for electrically contacting the first electrical contact 27 when the first and second head portions 15, 17 are urged to the closed position. The first electrical contact means 27 preferably includes first and second electrical contact members 31, 33 for being attached to the first head portion 15. Likewise, the second electrical contact means preferably includes first and second electrical contact members 35, 37 attached to the inner side of the second head portion 17. Each electrical contact member 31, 33, 35, 37 preferably consists of an electrically conductive plate member 38 constructed of any electrically conductive material, such as copper, aluminum or the like, and attached to the respective head portion 15, 17 in any manner apparent to those skilled in the art (see, in general, FIGS. 5 and 6). Additionally, each electrical contact member 31, 33, 35, 37 may include electrically conductive bolt means having a threaded rod 39 which extends through an aperture 41 in the head portions 15, 17 which is secured to the head portions 15, 17 by a nut 43 or the like for holding the respective plate member 38 to the body means 13 (see, in general, FIGS. 5 and 6). The head 44 of each bolt means may be positioned in an offset manner with respect to the head 44 of the bolt means of the opposing electrical contact member so as to insure a good electrical connection between each head 44 and the plate member 38 of the opposing electrical contact member when the head portions 15, 17 are in the closed position as clearly shown in FIGS. 5 and 6. Thus, the electrical contact members 31, 33, 35, 37 are positioned on the head portions 15, 17 of the body means 13 in such a manner that the first and second electrical contact members 31, 33 of the first electrical contact means 27 make electrical contact with respective first and second electrical contact members 35, 37 of the second electrical contact member 29 when the first and second head portions 15, 17 are in the closed position.

Figure 2:
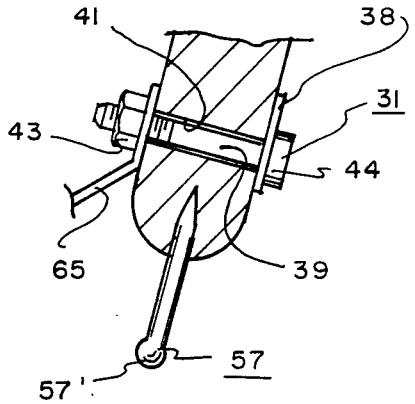
FIG. 2 is an enlarged sectional view of the first head portion of the body means of the alarm means of the present invention.
Figure 3:
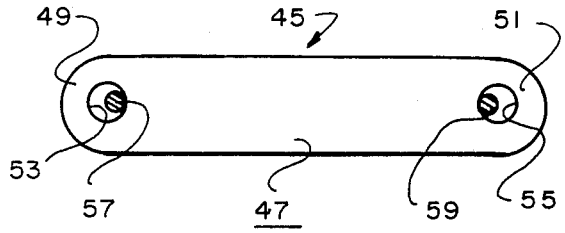
FIG. 3 is an enlarged sectional view substantially as taken on line III—III of FIG. 1.

The alarm means 11 includes a fusible means 45 for being attached relative to the first and second head portions 15, 17 of the body means 13 and for normally holding the first and second head portions 15, 17 in the open position to normally hold the first and second electrical contact means 27, 29 out of electrical contact with one another (see FIG. 1). The fusible means 45 is adapted to be rendered ineffective at a certain temperature in holding the first and second head portions 15, 17 in the open position to then allow the first and second electrical contact means 27, 29 to electrically contact one another. The fusible means 45 preferably includes an elongated fusible link member 47 having a first end 49 and a second end 51 and having a first aperture 53 through the first end 49 and having a second aperture 55 through the second end 51 (see, in general, FIG. 3). Such fusible link members are well-known to those skilled in the art and available from various sources such as, for example. Elsie Manufacturing Co. located at Pine and Maple Streets, Waterloo, Indiana. Such fusible link members are Underwriters Laboratory approved and rated at various temperatures, such as, for example, 135 degrees, 160 degrees, 212 degrees Farenheit, etc. The specific construction and physical characteristics of such fusible link members will be apparent to those skilled in the art. Thus, it will be understood that the fusible link member 47 will be rendered ineffective in holding the head portions 15, 17 in the open position when exposed to a predetermined temperature. The fusible link member 47 may be attached relative to the head portions 15, 17 in any manner now apparent to those skilled in the art. Preferably, the alarm means 11 includes a first pin member 57 for being attached to and extending outwardly of the first head portion 15 and includes a second pin member 59 for being attached to and extending outwardly from the second head portion 17 (see, in general, FIGS. 1, 2 and 4). The fusible means 45 can then be attached between the first and second pin members 57, 59. Thus, the first and second apertures 53, 55 in the first and second ends 49, 51 of the fusible link member 47 may receive the first and second pin members 57, 59 and the force of the spring member 25 urging the head portions 15, 17 to the closed position also urges the first and second pin members 57, 59 against the sides of the first and second apertures 53, 55 respectively to hold the link member 47 relative to the head portions 15, 17. The apertures 53, 55 are spaced apart from one another a distance sufficient to hold the head portions 15, 17 in the open position when the first and second pin members 57, 59 are received in the first and second apertures 53, 55 respectively. The pin members 57, 59 may be of any construction now apparent to those skilled in the art. For example, the pin members 57, 59 may consist of standard nails, or the like, hammered or otherwise fixedly attached to the first ends of the body members 21, 23. The pin members 57, 59 may have slightly enlarged heads 57', 59' to aid in holding the fusible link member 47 thereon.

The alarm means 11 includes circuit means as shown in FIG. 1 for being electrically coupled to the first and second electrical contact means 27, 29 and for producing an alarm signal if the first and second electrical contact means 27, 29 make electrical contact with one another. Preferably, the circuit means includes a first circuit for being electrically coupled to the first electrical contact members 31, 35 of the first and second electrical contact means 27, 29 and a second circuit for being electrically coupled to the second electrical contact members 33, 37 of the first and second electrical contact means 27, 29. The alarm means 11 is preferably installed within a building having a typical light system 61 including one or more standard light members 63 for selectively lighting the interior and/or exterior of the building and the like. The first circuit of the circuit means is preferably electrically coupled to the light system 61 for producing a visible alarm signal when the first and second head portions 15, 17 of the body means 13 are in the closed position. The specific electrical pathway provided by the first circuit may vary in any manner now apparent to those skilled in the art. Thus, for example, a first electrically conductive wire 65 may extend from the electrical contact member 31 to one or more light members 63, a second electrically conductive wire member 67 may extend from light members 63 to a typical source of electrical energy 69, and a third electrically conductive wire 71 may extend from the source of electric energy 69 to the electrical contact member 35, thereby causing a closed electrical circuit to be provided between the light member 63 and source of electrical energy 69 when the first electrical contact members 31, 35 of the first and second electrical contact means 27, 29 electrically contact one another (i.e., when the head portions 15, 17 are in the closed position). The first and third electrically conductive wires 65, 71 may be electrically coupled to the electrical contact members 31, 35 in any manner now apparent to those skilled in the art. Thus, for example, the bolt means of each electrical contact member to the respective body member may act as a typical terminal in providing an electrical connection to the various electrical contact members.

The alarm means 11 is also preferably installed within a building having an audible entrance signaling system 73 including a typical doorbell mechanism 75 or the like and the second circuit of the circuit means is preferably electrically coupled to the audible entrance signaling system 73 for producing an audible alarm signal when the first and second head portions 15, 17 are in the closed position. The specific electrical pathway provided by the second circuit may vary in any manner now apparent to those skilled in the art. Thus, for example, the second circuit may include a first electrically conductive wire 77 extending between the second electrical contact member 33 of the first electrical contact means 27 and the doorbell mechanism 75, a second electrically conductive wire 79 extending between the doorbell mechanism 75 and the source of the electrical energy 69, and a third electrically conductive wire 81 extending from the source of electrical energy 69 and the second electrical contact member 37 of the second electrical contact means 29 to thereby provide a closed electrical circuit between the doorbell mechanism 75 and the source of electrical energy 69 when the second electrical contact members 33, 37 of the second electrical contact means 29 make electrical contact with one another (i.e., when the head portions 15, 17 are in the closed position). The first and third electrically conductive wires 77, 81 may be electrically coupled to the electrical contact members 33, 37 in any manner now apparent to those skilled in the art. Thus, for example, the bolt means of each electrical contact member to the respective body member may act as a typical terminal in providing an electrical connection to the various electrical contact members.

The alarm means 11 is preferably installed within the building with the first end of the first and second body members 21, 23 (i.e., the first and second head portions 15, 17) directed downwardly.

As thus constructed and used, the alarm means 11 provides an automatic fire protection and alarm to the occupants of a building. Thus, in the event of a fire or the like in a building in which the alarm means 11 is installed, once the ambient temperature adjacent the alarm means 11 reaches a certain degree, the fusible link means 47 will be rendered ineffective by melting or the like, thus allowing the head portions 15, 17 of the body means 13 to move to the closed position, thereby activating the light system 61 and audible entrance signaling system 73, or the like, thereby producing both visual and audible alarm signals and allowing the occupants of the building to safely depart the building.

Although the present invention has been directed and illustrated with respect to a preferred embodiment thereof and a preferred use therefore, the present invention is not to be so limited since changes and modifications can be made therein which are within the full intended scope of the invention.

I claim:

1. Alarm means installed in a building having a light system and an audible entrance signalling system for producing an alarm signal when the temperature at a certain location rises to a pre-selected degree, said alarm means comprising:

(a) body means including a first head portion, a second head portion, said first and second head portions being movable between an open and a closed position and being electrically insulated relative to one another when in said open position, and urging means for normally urging said first and second head portions to said closed position; said body means including first and second body members, each of said body members having a first end and a second end with said first ends of said first and second body members respectively defining said first and second head portions; said urging means including a spring member for pivotally joining said first and second body members to one another in such a manner that said first ends thereof are movable between open and closed positions and normally urged to said closed position; said first and second body members of said body means being constructed of electrically non-conductive material;

(b) first electrical contact means for being positioned on said first head portion of said body means; said first electrical contact means including first and second electrical contact members;

(c) second electrical contact means for being positioned on said second head portion of said body means and for electrically contacting said first electrical contact means when said first and second head portions of said body means are urged to said closed position; said second electrical contact means including first and second electrical contact members for making electrical contact with the respective said first and second electrical contact members of said first electrical contact means when said first and second head portions of said body means are in said closed position;

(d) fusible means for being attached relative to said first and second head portions of said body means and for normally holding said first and second head portions in said open position to normally hold said first and second electrical contact means out of electrical contact with one another, said fusible means being rendered ineffective at a certain temperature to then allow said first and second electrical contact means to electrically contact one another;

(e) circuit means for being electrically coupled to said first and second electrical contact means and for producing an alarm signal if said first and second electrical contact means make electrical contact with one another; said circuit means including a first circuit for being electrically coupled to said first electrical contact members of said first and second electrical contact means and including a second circuit for being electrically coupled to said second electrical contact members of said first and second electrical contact means; said first circuit of said circuit means being electrically coupled to said light system for producing a visible alarm signal when said first and second head portions of said body means are in said closed position; said second circuit being electrically coupled to said audible entrance signalling system for producing an audible alarm signal when said first and second head portion of said body means are in said closed position;

(f) a first pin member for being attached to and extending outwardly from said first end of said first body member; and (g) a second pin member for being attached to and extending outwardly from said first end of said second body member; said fusible means being attached to said first and second pin members.

2. The alarm means of claim 1 in which said fusible means includes an elongated link member having first and second ends and having a first aperture through said first end thereof for receiving said first pin member and a second aperture through said second end thereof for receiving said second pin member, said first and second apertures being spaced apart a distance sufficient to hold said first and second body members in said open position when said first and second pin members are received in said first and second aperture respectively.

3. The alarm means of claim 2 in which the force of said spring member urging said first ends of said first and second body members to said closed position also urges said first and second pin members against the sides of said first and second apertures through said link member to hold said link member relative to said first ends of said first and second body members.

4. The alarm means of claim 3 in which said alarm means is installed within said building with said first ends of said first and second body members directed downwardly.

* * * * *